United States Patent [19]

Carlton

[11] Patent Number: 4,672,945

[45] Date of Patent: Jun. 16, 1987

[54] ARCHERY TRIGGER RELEASE MECHANISM

[76] Inventor: William G. Carlton, P.O. Box 592, Folly Beach, S.C. 29439

[21] Appl. No.: 642,097

[22] Filed: Aug. 20, 1984

[51] Int. Cl.[4] ..... F41C 19/00; F41B 5/00

[52] U.S. Cl. ..... 124/35 A; 124/88

[58] Field of Search ..... 124/35 A, 40, 24 R, 124/25, 35 R, 21

[56] References Cited

U.S. PATENT DOCUMENTS

| | | | |
|---|---|---|---|
| 2,815,016 | 12/1957 | Kellogg | 124/40 |
| 4,041,926 | 8/1977 | Troncoso, Jr. et al. | 124/35 A |
| 4,061,125 | 12/1977 | Trotter | 124/24 R |
| 4,232,649 | 11/1980 | Allen et al. | 124/35 A |
| 4,391,263 | 7/1983 | Dodge | 124/35 A |
| 4,498,448 | 2/1985 | Fletcher | 124/35 A |

*Primary Examiner*—Richard C. Pinkham
*Assistant Examiner*—Benjamin Layno
*Attorney, Agent, or Firm*—B. Craig Killough

[57] ABSTRACT

A trigger release mechanism for use with an archery bow and arrow is disclosed. Within the body member of the trigger release is a trigger and a rotating member into which a drawn bow string is placed. The rotating member with the drawn bow string in place engages with the trigger release mechanism through a gear interaction. The bow string and rotating member are held in a cocked position due to on increased radius of one or both of these members such that rotation cannot take place in the gear interaction. Upon depression of the trigger the rotating member is allowed to rotate, releasing the bow string. The mechanism is further designed so that when the trigger is released by the user, the trigger automatically positions the rotating member back to its reloading position. A safety is also incorporated to prevent accidental release of the bow string by selectively preventing travel of the trigger.

2 Claims, 10 Drawing Figures

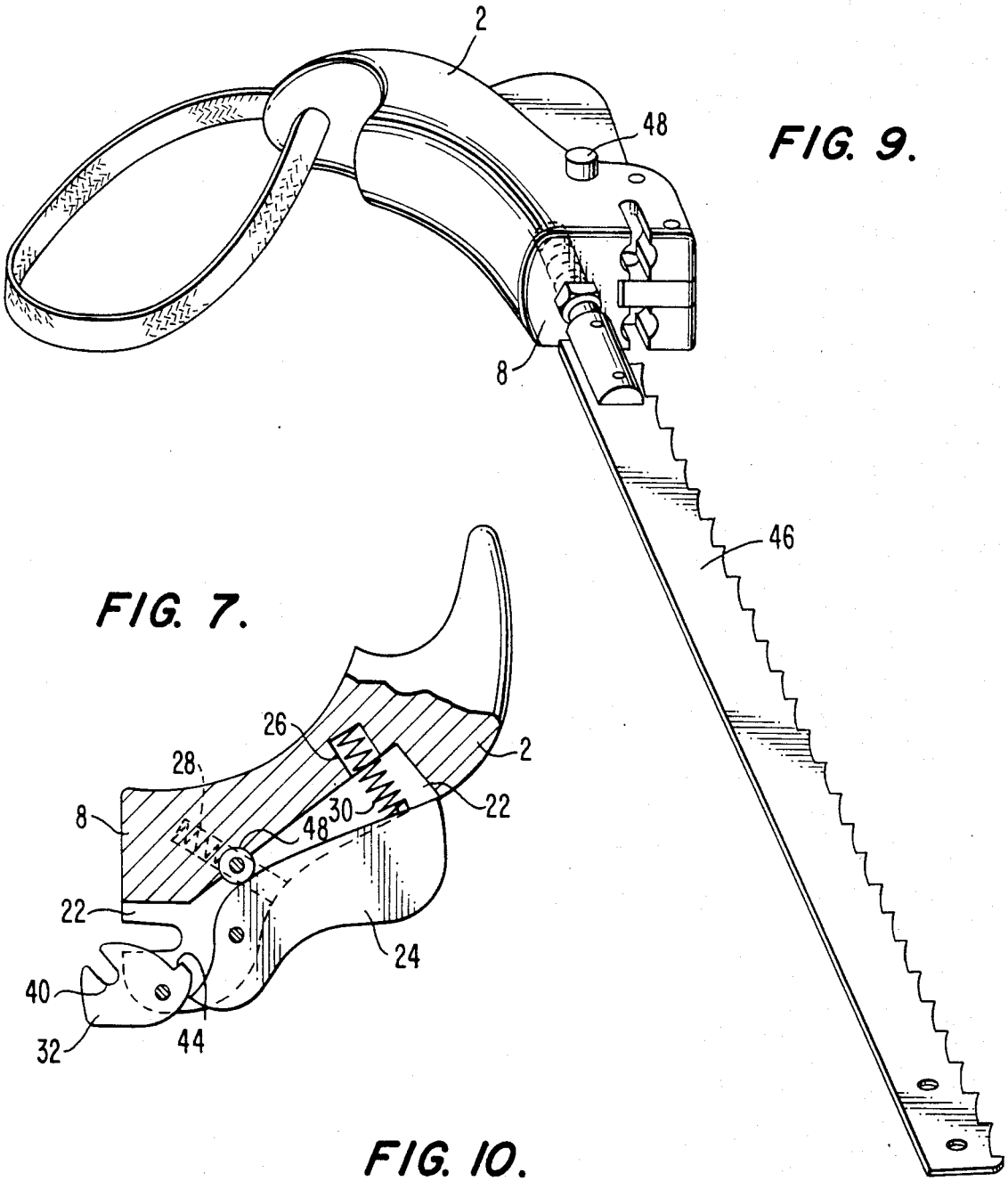
FIG. 9.
FIG. 7.
FIG. 10.
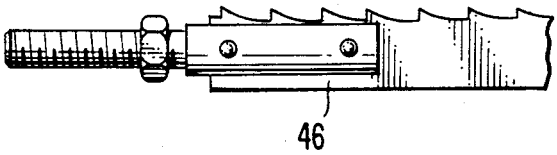

ARCHERY TRIGGER RELEASE MECHANISM

SUMMARY AND BACKGROUND OF THE INVENTION

This invention relates generally to the field of archery, and more particularly to a trigger release mechanism which may be used in conjunction with an archery bow.

The prior art reveals many examples of triggers and bow string releases. These devices aid the archer by giving a more secure and positive grip on the bow string, allow a more positive release and aid in avoiding the accidental release of the bow string. In certain embodiments, these devices dictate a constant and uniform draw on the bow string, and hold the bow string in the draw position at a uniform point on the draw string, resulting in superior power and accuracy.

The prior U.S. Pat. Nos. to Allen, et.al 4,232,649 and Boyko 3,998,202 reveal examples of bow string release devices. Both of these devices reveal a rotating member into which the bow string is placed. A moveable stop holds the rotating member in place, resisting the pull of the bow string. When the stop is pulled away from the rotating member, the tension to bow string causes the rotating member to move to a position which allows release of the bow string.

In both Allen and Boyko, the rotating member, with tensioned bow string in place, pushes against the stop member, with the force of the rotating member against the stop member being in such a manner as to push the stop member away causing a release of the device. A great deal of force is exerted on the point where the rotating member contacts the stop member, and the tendency of these members in the potential energy position is to force themselves away from each other. In these examples of the prior art, as the bow string pressure increases, so does the pressure on the point where the rotating member contacts the stop member. This increases the likelihood of material wear failure, and makes release more difficult as bow string draw is increased. These tendencies of the prior art devices therefore combine to represent an upper limitation or maximum operating capacity, which is directly correlated to the mechanical design.

The present invention also uses a rotating member into which a bow string is placed. However, as disclosed herein, the force of the bow string on the rotating member holds the stop or trigger in the cocked position, rather than using the stop resist the rotating member. The tendency of the rotating member is to rotate the trigger into the cocked position, so that the rotating member and trigger work together to hold the device in the cocked position. The trigger tends to chock the rotating member and prevent it from rotating. This eliminates the use of a small contact point having a great deal of force placed upon it, and secondly, the rotating cam and stop or trigger work together to hold the mechanism in the cocked position, rather than resisting each other as revealed by the devices in the prior art. In this manner, the present invention is rendered safer and more durable than those devices shown in the prior art, and is not limited by high draw forces.

Additionally, in the present invention, the increasing radius on one surface of the rotating member works with the trigger to slow, and then stop, rotation of the rotating member after the bowstring is released, and then to counter-rotate the rotating member. Counter rotation is accomplished by releasing the trigger member, which automatically returns the bow string slot to an optimal reloading position, as will be detailed further herein. The preferred embodiment, as will be shown, incorporates a safety, which is not contemplated by the prior art. The safety allows the archer to secure the device with bowstring in place in a locked or safe position, which facilitates the act of drawing the bowstring and eliminates the potential for accidental release.

Another feature incorporated in the present invention provides for the placement of the arrow within the body of the trigger release mechanism, so that it need not be held or even touched by the archer. The present invention further provides for use in a free-draw or unsupported mode as well as a supported mode. Still another unique feature is the attachment of a wrist band which supports the entire weight of bow draw hwen used in the free-draw mode, and provides valuable steadying device when used in the supported mode. Yet another feature of the present invention is that the body may be used as a handle for the attachment of accessories to assist the archer in the field, as a short saw or saw with multiple extensions.

DETAILED DESCRIPTION OF THE DRAWINGS

FIG. 7 is essentially identical to FIGS. 4, 5 and 6, but shows the archery trigger release mechanism in position for reloading.

FIG. 9 is a perspective view of the bow string release mechanism shown mounted to a saw blade rather than to an archery bow.

FIG. 10 is a fragmentary, lap view of the saw blade accessory.

DETAILED DESCRIPTION OF THE PREFERRED EMBODIMENT

Figure 1:
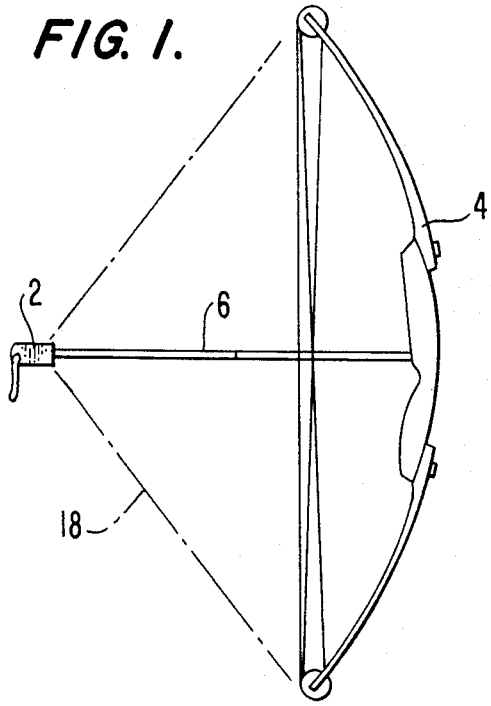
FIG. 1 is a side elevation of a compound bow which has been modified to use the archery trigger release mechanism.
Figure 2:
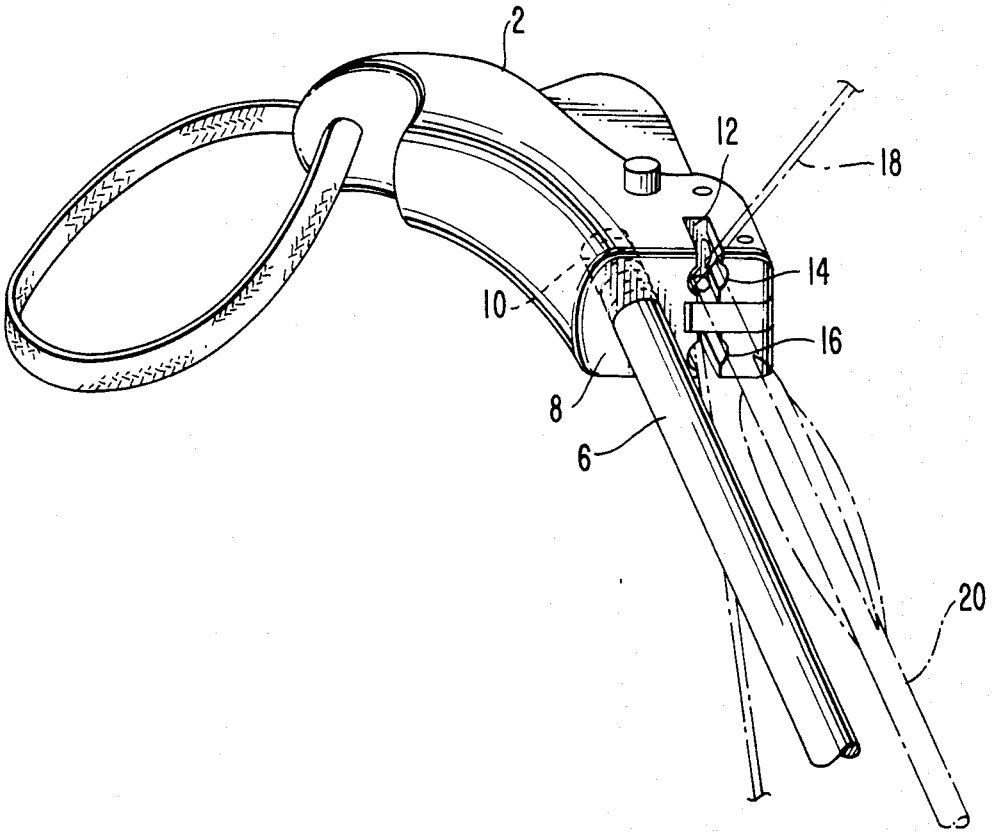
FIG. 2 is a fragmentary, perspective view showing the archery release mechanism and support rod, with a bow string and an arrow shown as phantoms.
Figure 3:
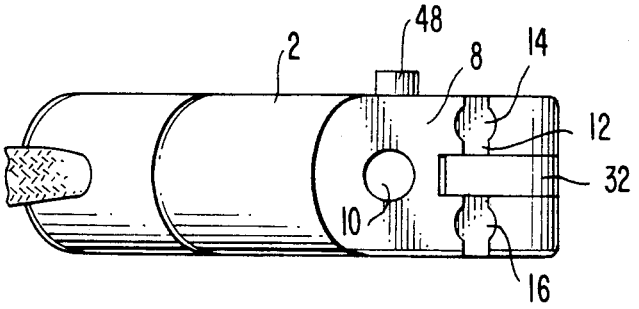
FIG. 3 is a side elevation showing the archery trigger release mechanism.

Referring initially to FIG. 2, the device has a body member 2 over which the archer places his or her hand. This body member 2 is a rigid, elongated member having a dog leg shape which fits the archer's hand. The body member 2 is shown attached to the bow 4 by means of a rod 6 which is threaded on each end and engaged into the bow 4 and into the body member 2 (FIG. 1). The surface 8 of the body member 2 to which the rod 6 is attached, is relatively flat. A threaded void 10 opens on this surface 8, and a slot 12 running across two circular voids 14,16 is provided through which the bow string 18 runs, and into which an arrow 20 is placed. The device may be oriented relative to the bow for a left or right hand user by turning it 180°, with the arrow placed in the proper void 14,16 for either a left or right hand user. The arrow may be placed in the selected void prior to and without necessitating actuation of the release.

A longitudinal void 22 is provided within the body member 2, and a release or trigger 24 is placed within this longitudinal void 22 (FIGS.4, 5, 6, 7). The longitudinal void 22 runs through to the flat surface 8 of the body member 2, with an eccentric rotating pivot member 32 being pivotally mounted within such longitudinal void 22 and near the flat surface 8 of the body member 2.

Two cylindrical holes 26,28 are placed within the body member 2. The first hole 26 opens within the longitudinal void 22, with a spring 30 placed in the hole 26 to spring bias the trigger 24. The second hole 28 shown as a phantom, is used to spring bias a sphere or ball bearing used in conjunction with the safety mechanism, as will be discussed further herein. This hole 28 is located just off the place of the void 22.

The release or trigger 24 is a relatively flat, elongated member having a dog leg shape. It is pivotally mounted within the longitudinal void 22 of the body member 2, with the pivot point being relatively near the position of the eccentric pivot member 32. On this same end, near the pivot, the trigger 24 has a bird beak shaped point 34 which is used to contact the eccentric pivot member 32 as will be more fully described. On the opposite end of the trigger member 24, a spring 30 is used to spring bias the trigger 24. Roll pins 36,38 may be used to pivotally attach the trigger 24 and pivot member 32, respectively, to the body member 2.

As shown in FIG. 2, the body member 2 may be attached to the compound bow 4 by means of a threaded rod 6. FIG. 2 shows the position of the device as it would be used by a right hand user. The user's hand is placed over the body member 2, with the thumb positioned over the trigger 24. The bow string 18 is pulled within the slot 12 in the body member 2, being held in place within a slot 40 on the eccentric pivot member 32. The arrow 20 is placed into the appropriate circular void 14 through which the slot 12 runs, and over the bow string 18.

The device may be used with or without the threaded rod support 6. If used without the rod support, a leather or cloth wrist strap 42 is provided to aid in the drawing the bow. The device may be attached to the bow string 18 which is then drawn with the strap 42. When used with the rod 6, the strap 42 may be used to support the bow by the wrist or arm of a user who is handicapped manually.

Figure 4:
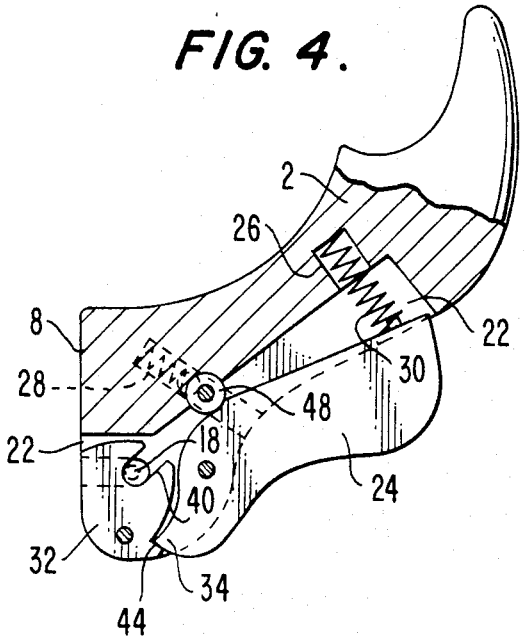
FIG. 4 is a top, plan view of the release mechanism with the body broken away to show the internal elements.
Figure 5:
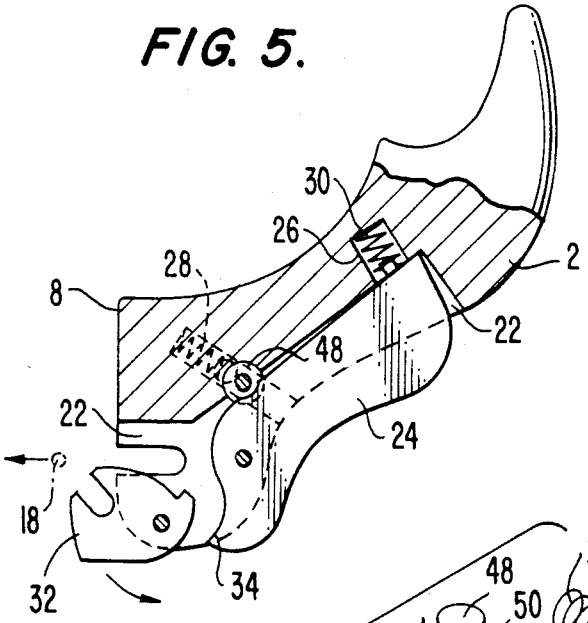
FIG. 5 is essentially identical to FIG. 4, additionally showing the action of the internal construction as the bow string is released.
Figure 6:
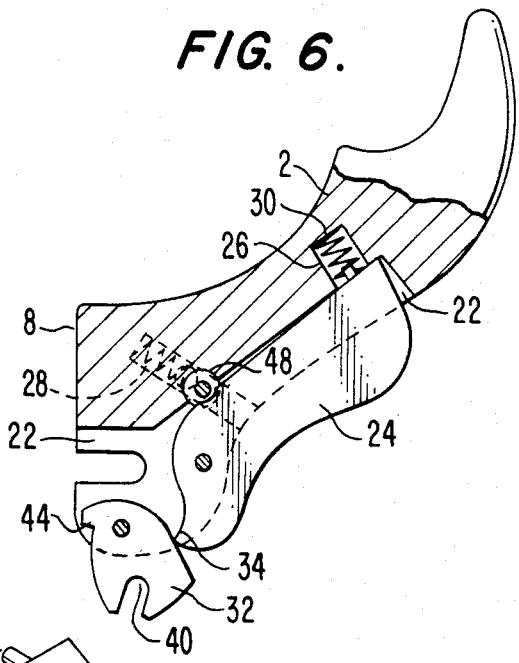
FIG. 6 is essentially identical to FIGS. 4 and 5, showing the relative position of the internal elements after the bow string has been released.

Referring now to FIG. 4, which shows the mechanism in its "cocked" position, the bow string 18 rests within a slot 40 in the pivot member 32. The tension or pull of the bow string 18 in the drawn position causes the eccentric pivot member to desire to rotate counterclockwise. A step 44 on the pivot member 32 is forced against the birdbeak-shaped point 34 of the trigger 24, which prevents the pivot member 32 from rotating and releasing the bow string. Moving now to FIG. 5, as the trigger 24 is depressed, the point 34 of the trigger 32 moves away from the step 44 of the pivot member 32, allowing the pivot member 32 to rotate. This rotation allows the slot 40 on the eccentric pivot member 32 to rotate outside of the body member 2, releasing the bow string 18 and taking the arrow with it. As the pivot member 32 continues to rotate, it again contacts the point 34 of the trigger (FIG. 6). The increasing radius of the surface of the pivot member allows a gradual slowing and then stopping of the pivot member. This method of stopping the pivot is superior to the use of an absolute stop since it eliminates the shock and impact of a sudden contact of a rotating member against a dead stop. Releasing the trigger automatically returns the pivot member to its optimal position for reloading (FIG. 7). As the point 34 of the trigger moves along the surface of the pivot 32 during release, it pushes the pivot 32 out to the reload position. The spring biasing of the trigger aids in this return.

The device may be cocked by again drawing the bow string 18 and inserting it into the slot 40 on the pivot member 32, and rotating the pivot member 32 clockwise until it reaches the position shown in FIG. 4, and is held in place by the trigger 24.

While the device incorporates many features which are not found in the prior art, the primary feature of the invention is the interaction between the trigger 24 and the pivot member 32. When viewed as in FIG. 4, the tendency of pivot member 32 in the cocked position is to rotate counterclockwise, which causes the trigger 24 to tend to rotate clockwise into its cocked, rather than released, position. In this manner, the tension of the bow string is used to hold the device in its cocked position. When the device is in its cocked position, the pivot member and trigger interact as two gears, in that as one rotates in a counterclockwise direction, the tendency of the other is to rotate in a clockwise direction. However, the particular cut of the eccentric pivot member and the trigger allow for an unusual occurence to happen after the bow string has been released. As the trigger 24 is released from its position in FIG. 6, the spring 26 causes the trigger 24 to pivot in a clockwise direction. As the trigger 24 rotates clockwise, it pushes the eccentric pivot member 32 in a clockwise direction, returning the member 32 to its optimal position for reloading, as in FIG. 7. Therefore, while the tendency of the trigger and pivot member is to rotate in opposite directions to maintain the cocked position, after the bowstring is released, these members interact to rotate in the same direction to position the pivot member for the reloading of the bowstring.

Figure 8:
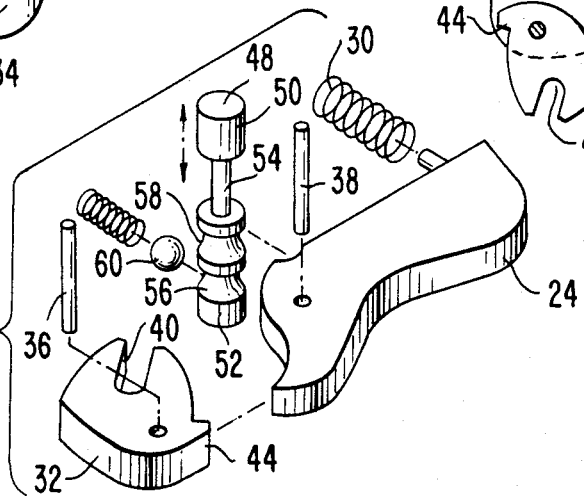
FIG. 8 is an exploded view of the internal elements of the archery trigger release mechanism shown in isolation.

The bow string release mechanism also incorporates a safety to prevent accidental release of the bow string. A sliding cylinder 48 is located within a void in the body member 2. This void runs all of the way through the width of the body member, perpendicular to the longitudinal void 22 in which the trigger is contained. The cylinder 48 is of slightly longer length than the length of the void, and on each end, is of slightly less diameter so as to allow the cylinder to slide. Along the length of the cylinder 22 its diameter 54 is further reduced so as to allow travel of the trigger 24 within the longitudinal void 22. FIG. 8 Moving along the length of the cylinder, two radiuses 56,58 are cut about the circumference of the cylinder 48, leaving an overall diameter which will prevent travel of the trigger 24 when this portion of the cylinder 48 is slid within the void to a position underneath the trigger 24. The purpose of the radiuses 56,58 is to allow a sphere 60, which may be a ball bearing, to be located within the radiuses 56,58 as the cylinder 48 slides within the void, to allow definite, yet smooth, positioning of the cylinder 48 so that it either prevents or allows movement of the trigger.

Pins 36,38, which may be roll pins, are used to allow the pivoting of the trigger 24 and the pivot member 32, and the spring 62 which biases the sphere 60 against the cylinder 48. FIG. 8 further details the spring 30 which biases the trigger 24 within the body member 2.

In the preferred embodiment, the body member 2 is held at a constant distance and position from the bow 4 by the use of the threaded rod 6. This distance may be changed by varying the length of the rod, as is desired by the user. One of the main functions of holding the release mechanism at a constant distance is that the bow may be drawn by a user who is partially handicapped or who does not have sufficient strength to draw the bow normally, by placing the bow on the ground and using both hands to pull the bow string to its fully drawn position, while holding the bow in place with the feet. Additionally, by placing the trigger release mechanism at a fixed distance, a consistent draw is achieved from use to use. It is believed that accuracy and safety are improved by drawing and releasing the bow string at the same point on the bow string during each use.

The void 10 in the body member into which the threaded rod 6 is inserted allows other accessories to be used in conjunction with the device, with the body member 2 being used as a handle for these accessories FIGS. 9, 10. One of these accessories is a saw attachment 46 which may be carried on the belt of the hunting archer, and threaded into the body member 2 for cutting branches, meat and the like.

In the preferred embodiment, the body member 2 is made of solid one piece cast aluminum, machined as depicted and described herein. The trigger 24, pivot member 32, and cylinder 48 are also aluminum. While aluminum is the preferred material due to its strength, weight and cost, others suitable materials could be used.

What is claimed is:

1. A trigger release mechanism for use with an archery bow, comprising:

a. an elongated body member having an open longitudinal void therein further opening to a frontal surface of said body member, wherein said frontal surface of said body member is flat, and has a void therein into which a bowstring is placed, said void being perpendicular to and intersecting said longitudinal void, and having a cylindrical void on either side of said longitudinal void and engaging said perpendicular void, into which an arrow may be placed so as to engage said bowstring;

b. a pivot member rotatably mounted within said void near the frontal surface thereof, and having a slot therein into which said bow string is placed; and c. a trigger member rotatably mounted within said void and engaging said pivot member on a surface thereof so as to tend to be rotated by said pivot member as said pivot member rotates in a direction opposite thereto, wherein the engagement of the trigger member stops the rotation of said pivot member by an increasing radius of said trigger member and/or said pivot member along said surface so as to prevent the release of said bow string, and whereby said pivot member is allowed to rotate and release said bow string upon disengagement of said trigger member from said pivot member.

2. A trigger release mechanism for use with an archery bow, comprising:

a. an elongated body member having an open longitudinal void therein further opening to a frontal surface of said body member, and wherein said frontal surface of said body member is flat, and has a void therein into which said bow string is placed, being perpendicular to and intersecting said longitudinal void, and having a cylindrical void on either side of said longitudinal void and engaging said perpendicular void, into which an arrow may be placed so as to engage said bow string;

b. a pivot member rotatably mounted within said longitudinal void near said frontal surface, having a slot therein into which said bow string may be placed, and further having a step therein;

c. a trigger member rotatably mounted within said longitudinal void and engaging said pivot member so as to tend to be rotated by said pivot as said pivot member rotates and in an opposite direction thereto, and having a point thereon which engages said step in said pivot member so as to stop the rotation of said pivot member and the release of said bow string, and whereby said pivot member is allowed to rotate and release said bow string by counter-rotating said pivot member so as to disengage said point from said step.

* * * * *